US011578640B1

(12) United States Patent
Schuricht et al.

(10) Patent No.: US 11,578,640 B1
(45) Date of Patent: Feb. 14, 2023

(54) SYSTEMS AND METHODS FOR PREVENTING ENGINE OVERCOOLING

(71) Applicant: Caterpillar Inc., Peoria, IL (US)

(72) Inventors: Scott R. Schuricht, Princeville, IL (US); Shah S. Kareemullah, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/648,966

(22) Filed: Jan. 26, 2022

(51) Int. Cl.

| | |
|---|---|
| ***F01P 7/14*** | (2006.01) |
| ***F01P 5/02*** | (2006.01) |
| ***F02M 31/20*** | (2006.01) |
| ***F01P 7/16*** | (2006.01) |

(52) U.S. Cl.
CPC ..... *F01P 7/14* (2013.01); *F01P 5/02* (2013.01); *F01P 7/165* (2013.01); *F02M 31/20* (2013.01); *F01P 2007/146* (2013.01); *F01P 2025/08* (2013.01); *F01P 2050/02* (2013.01); *F01P 2050/06* (2013.01)

(58) Field of Classification Search
CPC ..... F01P 7/14; F01P 5/02; F01P 2007/146; F01P 2025/08; F01P 2050/02; F01P 2050/06; F01P 7/165; F02M 31/20; F02M 35/165
See application file for complete search history.

(56) References Cited

U.S. PATENT DOCUMENTS

| | | | | |
|---|---|---|---|---|
| 4,325,219 | A | 4/1982 | Stang et al. | |
| 4,520,767 | A | 6/1985 | Roettgen et al. | |
| 5,121,714 | A | 6/1992 | Susa et al. | |
| 5,295,880 | A | 3/1994 | Parker | |
| 6,554,664 | B1 | 4/2003 | Nanami | |
| 6,851,992 | B2 | 2/2005 | Matsuo | |
| 7,086,370 | B2 | 8/2006 | Yonezawa et al. | |
| 7,137,364 | B2 | 11/2006 | Takahashi | |
| 7,264,520 | B1 * | 9/2007 | Taylor | F01P 11/08 440/88 HE |
| 7,543,558 | B2 | 6/2009 | Buck | |
| 7,717,069 | B2 | 5/2010 | Mokire et al. | |
| 10,018,103 | B2 | 7/2018 | Ito et al. | |
| 2013/0186351 | A1 * | 7/2013 | Quix | F01P 5/10 123/41.02 |
| 2013/0255598 | A1 * | 10/2013 | McConville | F01P 7/165 123/41.1 |

FOREIGN PATENT DOCUMENTS

| | | | |
|---|---|---|---|
| JP | 2005036731 | A | 2/2005 |

* cited by examiner

*Primary Examiner* — Jacob M Amick
(74) *Attorney, Agent, or Firm* — Bookoff McAndrews PLLC

(57) ABSTRACT

A cooling system includes an internal combustion engine, a coolant pump in fluid communication with the internal combustion engine, and a liquid-to-liquid heat exchanger configured to receive coolant from the internal combustion engine via the coolant pump. The cooling system also includes a bypass valve connected downstream of the coolant pump, the bypass valve configured to close a fluid path that connects the coolant pump and the liquid-to-liquid heat exchanger.

20 Claims, 3 Drawing Sheets

SYSTEMS AND METHODS FOR PREVENTING ENGINE OVERCOOLING

TECHNICAL FIELD

The present disclosure relates generally to methods and systems for internal combustion engine systems and, more particularly, to systems and methods for an internal combustion engine system with overcooling prevention.

BACKGROUND

Internal combustion engines, and especially internal combustion engines for use in marine applications, are frequently designed as large, high-output systems used to provide propulsion or generate electrical power. These systems generate significant amounts of heat, and require cooling to maintain a suitable operating temperature. Marine engines frequently employ water-to-water heat exchangers in which a first liquid coolant is cooled with a second liquid coolant, which can be seawater or fresh water. Cooling systems for these internal combustion engines include a series of loops for circulating the liquid coolant. Some marine engine systems employ an individual coolant-supplying pump for each of these loops, such that a first pump supplies seawater for heat exchange, a second pump supplies coolant (e.g., fresh water and/or coolant) for cooling cylinders of the engine itself, and a third pump supplies liquid coolant for cooling other components of the engine system (e.g., an intercooler for reducing the temperature of compressed air).

While these systems provide sufficient cooling capacity under the engine's rated load, the use of three separate pumps involves the use of significant space and cost. Two-pump systems can address these challenges, but introduce other problems. For example, consolidating pumps that supply coolant to the engine and to the air system in a single pump increases the likelihood of overcooling of the internal combustion engine, as cold water for the air system can be slow to warm during startup and under low load, resulting in engine temperatures that are undesirably low. Overcooling during startup, low load, or other conditions, can lead to overcooling that results in reduced engine performance, accelerated wear, or even damage to the engine.

An engine coolant system is described in U.S. Pat. No. 4,325,219 ("the '219 patent") to Stang et al. The coolant system in the '219 patent has a series of coolant loops, including a first loop that supplies coolant to an engine and a second loop that supplies coolant to an aftercooler, the second loop including a thermostat that can direct coolant through a branch that avoids the radiator. While the engine coolant system described in the '219 patent may be useful for systems that include an engine radiator, it may not be useful for marine systems and systems including liquid-to-liquid heat exchangers as part of a cooling system for a marine engine.

The systems and methods of the present disclosure may solve one or more of the problems set forth above and/or other problems in the art. The scope of the current disclosure, however, is defined by the attached claims, and not by the ability to solve any specific problem.

SUMMARY

In one aspect, a cooling system may include an internal combustion engine, a coolant pump in fluid communication with the internal combustion engine, and a liquid-to-liquid heat exchanger configured to receive coolant from the internal combustion engine via the coolant pump. The cooling system may also include a bypass valve connected downstream of the coolant pump, the bypass valve configured to close a fluid path that connects the coolant pump and the liquid-to-liquid heat exchanger.

In another aspect, a cooling system for a marine engine may include a heat exchanger, a coolant pump connected between the marine engine and the heat exchanger, and a coolant temperature sensor configured to generate a signal based on a temperature of coolant. The cooling system may also include an electronically-controlled bypass valve connected downstream of the coolant pump, the bypass valve configured to close a fluid path that connects the coolant pump and the heat exchanger and an electronic control module configured generate a command for controlling a state of the bypass valve based on the signal from the coolant temperature sensor.

In yet another aspect, a method for controlling a cooling system for an internal combustion engine may include pumping coolant in a first loop for cooling an interior of the internal combustion engine and pumping coolant in a second loop for cooling air supplied to the internal combustion engine. The method may also include determining that the internal combustion engine is in a low load state or a low temperature state, and in response to determining that the internal combustion engine is in the low load state or the low temperature state, closing a portion of the second loop.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a method or apparatus that comprises a list of elements does not include only those elements, but may include other elements not expressly listed or inherent to such a method or apparatus. In this disclosure, relative terms, such as, for example, "about," "substantially," "generally," and "approximately" are used to indicate a possible variation of ±10% in the stated value or characteristic. While the term "seawater" is used herein for convenience, "seawater" is intended to encompass both saltwater (e.g., ocean water) and freshwater (e.g., lake water, river water, etc.). As used herein, "coolant" excludes seawater, but includes any suitable cooling fluid, such as fresh water (e.g., deionized water), propylene glycol, ethylene glycol, and others, including mixtures.

Figure 1:
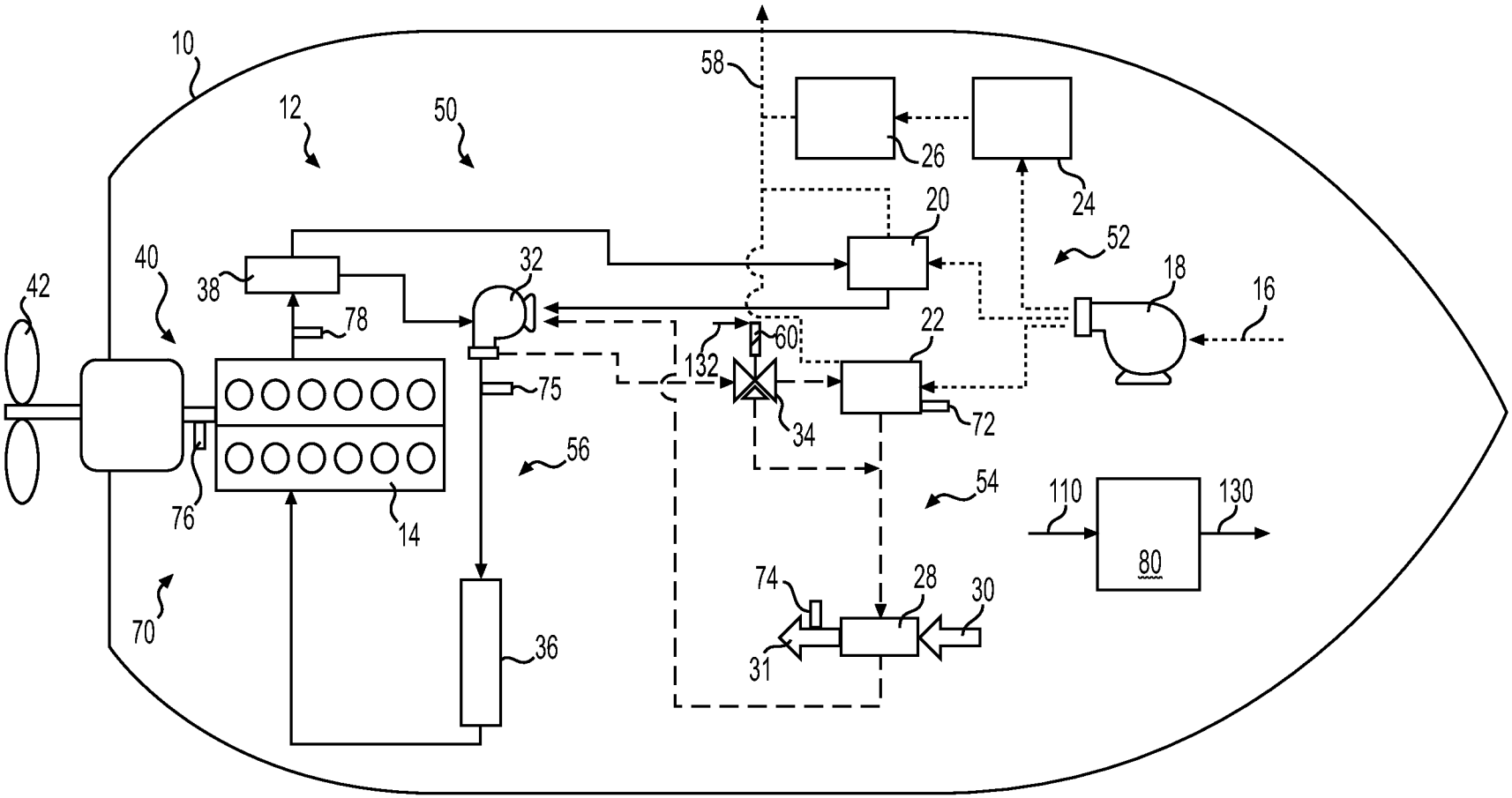
FIG. 1 is a schematic diagram of an engine system useful in a marine vessel, according to aspects of the disclosure.

FIG. 1 illustrates an exemplary engine system 12 for a marine vessel or ship 10 that may be capable of preventing engine overcooling events or reducing the severity and/or frequency of engine overcooling events. Engine overcooling events occur, for example, when coolant supplied to an engine is below about 50 degrees Celsius. Engine system 12 of ship 10 may include an internal combustion engine 14, a cooling system 50 for cooling internal combustion engine 14, a sensor system 70 for monitoring one or more aspects of system 12, and an electronic control module 80 in communication with sensor system 70. Cooling system 50 may include a plurality of paths (open or closed loops) for cooling engine 14 via a jacket water cooling system, and for cooling other aspects of an operating engine system, such as engine oil, gear oil, air passing within an intercooler, etc. Cooling system 50 may include one or paths for coolant and one or more paths for seawater, the seawater being useful to reduce the temperature of the coolant via heat exchange.

Ship 10 may be, for example, a tugboat, a cargoship or freighter, a yacht, a fishing boat, a passenger boat (e.g., a ferry), a patrol or emergency response boat, or any other type of recreational or commercial boat. Ship 10 may be propelled with internal combustion engine 14 connected to a propulsion device 42 via a coupling 40 which may include one or more flywheels, gearboxes, clutches, couplings, and/or transmission shafts. Ship 10 may also include one or more internal combustion engines 14 used as part of a generator set, a system which is not connected to a propulsion device 42 and that includes a generator in combination with engine 14.

Engine 14 may be a diesel engine, gasoline engine, gaseous fuel engine, or dual fuel engine (an engine capable of generating power by combusting liquid fuel, such as diesel or gasoline, and gaseous fuel, such as natural gas). Engine 14 may be a marine engine, an engine designed for placement in an engine room of ship 10. While engine 14 is shown as a twelve-cylinder engine having two rows of cylinders, engine 14 may have fewer cylinders, more cylinders, and/or a different arrangement of cylinders. Engine 14 may be configured to receive air via an air intake system (not shown) that includes a compressor, an intercooler, and an intake manifold. Intake air for engine 14 may be compressed with the air compressor (e.g., a compressor of a turbocharger, a supercharger, etc.), this compressed air being supplied to engine 14 for combustion with fuel. While one engine 14 is shown in system 12, as understood, a plurality of engines may be included in system 12, these engines being connected to cooling system 50 as shown for engine 14.

In the exemplary configuration shown in FIG. 1, cooling system 50 may include an open loop or seawater supply 52 represented with dotted lines, an air system cooling loop 54 represented with longer dashed lines, and an engine system cooling loop 56 represented with solid lines. Loop or supply 52 may be configured to supply seawater in an open loop, cooling loop 54 may be configured to supply coolant in a closed loop, and cooling loop 56 may be configured to supply coolant in another closed loop that is connected with loop 54. As shown in FIG. 1, cooling system 50 may include no more than two pumps, a pump that supplies seawater (e.g., pump 18 of loop 52, described below), and a pump that supplies coolant (e.g., pump 32 of loops 54 and 56, described below).

Seawater supply 52 of cooling system 50 may include a plurality of parallel paths configured to receive cooling fluid, such as seawater, and pass this seawater through heat exchangers to draw heat away from coolant and one or more components of engine system 12, as described below. Seawater supply 52 may include a water intake 16 configured to connect a seawater pump 18 to a source of water (e.g., a body of water in which ship 10 is floating). Seawater pump 18 may include one or more outlets that supply this seawater to a fuel cooler 24, a gear oil cooler 26, a jacket water heat exchanger 20, and an air cooler heat exchanger 22. This cooling seawater, after passing through one or more of these components, may exit ship 10 via ship outlet 58. While a single outlet 58 is shown in FIG. 1, as understood, ship 10 may include two more outlets 58, each path of seawater supply 52 including one or more individual outlets 58 to facilitate efficient routing of seawater supply 52.

As shown in the configuration illustrated in FIG. 1, a first path of seawater supply 52 may include water intake 16, pump 18, a fuel cooler 24, a gear oil cooler 26, and outlet 58. Fuel cooler 24 may include a heat exchange device in which fuel (e.g., fuel returning to a fuel tank from engine 14) is cooled by seawater pumped via seawater pump 18. Another heat exchange device, gear oil cooler 26, may connected downstream of fuel cooler 24, or alternatively, in parallel with, or downstream of, fuel cooler 24. Gear oil cooler 26 may be configured to cool oil for one or more transmission components (e.g., a gearbox of coupling 40) with seawater delivered via water pump 18. Seawater may exit ship 10 via an outlet 58.

A second path of seawater supply 52 may provide a flow of seawater to a cooling device associated with engine 14. In particular, this path of seawater supply 52 may include water intake 16, seawater pump 18, a jacket water heat exchanger 20 for cooling jacket water for engine 14 with seawater, and outlet 58. Seawater may enter an inlet of jacket water heat exchanger 20, absorb heat from engine coolant passing within jacket water heat exchanger 20, and exit jacket water heat exchanger 20. Seawater that exits heat exchanger 20 may be removed from ship 10 via outlet 58.

A third path of seawater supply 52 may connect seawater pump 18 to a component of the air supply system for engine 14, such as an air cooler heat exchanger 22. This third path may include water intake 16, seawater pump 18, air cooler heat exchanger 22, and outlet 58. Air cooler heat exchanger 22 may include an inlet connected to seawater pump 18 and an outlet connected to ship outlet 58.

Air system cooling loop 54 may provide a path for supplying coolant to one or more components of an air system that supplies compressed intake air to engine 14. For example, air system cooling loop 54 may include air cooler heat exchanger 22, a charge air cooler 28, a coolant pump 32, and a bypass valve 34. Liquid coolant in loop 54 may be configured to mix with liquid coolant contained in loop 56, as described below.

Air cooler heat exchanger 22 may be connected between seawater pump 18 and outlet 58 for receiving seawater. Air cooler heat exchanger 22 may also be connected between bypass valve 34 and charge air cooler 28. Thus, air cooler heat exchanger 22 may receive seawater supplied via seawater supply 52, and coolant (e.g., fresh water, propylene glycol, etc.) via loop 54. Air cooler heat exchanger 22 may be a shell and tube heat exchanger, a plate type heat exchanger (e.g., a gasketed plate heat exchanger), or any other suitable type of heat exchanger, that enables seawater of supply 52 to reduce the temperature of the coolant circulated in loop 54.

Charge air cooler 28 may be connected downstream of air cooler heat exchanger 22 and upstream of coolant pump 32 in loop 54. Charge air cooler 28 may also be connected between bypass valve 34 and coolant pump 32. Charge air cooler 28 may be an intercooler configured to cool intake air 30 via heat exchange with coolant circulated in loop 54. Charge air cooler 28 may be connected to an air compressor (not shown) of a turbocharger or supercharger, such that charge air cooler 28 receives compressed intake air 30 via an air intake of cooler 28. An air outlet of charge air cooler 28 may be connected to engine 14 so as to allow the supply of intake manifold air 31 to engine 14 via an intake manifold (not shown).

Pump 32 may be connected between charge air cooler 28 and bypass valve 34, such that coolant is supplied to charge air cooler 28 via bypass valve 34, this coolant returning to pump 32 from air cooler 28. Bypass valve 34 may be a three-way proportional valve having one inlet and two outlets. Valve 34 may be configured to supply coolant from pump 32 to only air cooler heat exchanger 22, to only charge air cooler 28, or to both. Valve 34 may be configured to supply an entirety of the coolant from pump 32 to heat exchanger 22 in a first position, to supply an entirety of the coolant from pump 32 to charge air cooler 28 in a second position, and to supply a portion of this coolant to both heat exchanger 22 and cooler 28 in a third position, as described below.

Alternatively, valve 34 may be a two-way valve that has a single inlet and a single outlet. When valve 34 is a two-way valve, valve 34 may be configured to restrict or block a portion of the flow of coolant to heat exchanger 22, or to restrict or block an entirety of the flow of coolant to heat exchanger 22, according to the temperature of this coolant, for example.

Valve 34 may be electronically-controlled, such that the position of valve 34 is controlled with an actuator 60. In an exemplary configuration, actuator 60 may be a solenoid actuator that, when valve 34 is in the first position, closes the path for coolant to bypass air cooler heat exchanger 22 and opens the path for coolant to flow to air cooler heat exchanger 22. Actuator 60 may be configured to, in the second position of valve 34, open the path for coolant to bypass heat exchanger 22 and close the path towards heat exchanger 22. Actuator 60 may bias valve 34 towards either the first position (in which valve 34 may be considered normally-open) or the second position (in which valve 34 may be considered normally-closed). When valve 34 is a proportional valve, the third position may include a plurality of positions, such that the proportion of flow between these two paths is controlled, e.g., via an ECM 80 that generates commands to control actuator 60. For example, by controlling an amount of current and/or a duty cycle of current supplied to energize the solenoid of actuator 60 with ECM 80, actuator 60 may cause valve 34 to enter a third position that partially or fully opens the path to both heat exchanger 22 and to charge air cooler 28.

In alternate configurations, valve 34 may be a mechanical valve that is not electrically actuated. For example, bypass valve 34 may be a thermostat-type valve that proportions flow between air cooler heat exchanger 22 and charge air cooler 28 based on the temperature of coolant that enters an inlet of valve 34. In mechanically-regulated embodiments, valve 34 may include a component that expands and contracts according to the temperature of coolant, allowing valve 34 to enter each of the above-described positions. Mechanical embodiments of valve 34 may be either three-way or two-way.

Engine system cooling loop 56 may connect pump 32 to engine 14 via an engine oil cooler 36. Engine oil cooler 36 may be connected to an outlet of pump 32 to receive coolant via pump 32, cool engine oil within cooler 36 via heat exchange, and provide this coolant to engine 14 via an outlet of cooler 36. If desired, path 56 may also include a bypass path (not shown) in which some coolant from pump 32 bypasses cooler 36 and is delivered to engine 14. Coolant supplied to engine 14 via loop 56 may enter a water jacket of engine 14 (e.g., a sealed coolant path adjacent to cylinders of engine 14, where the coolant receives heat from engine 14).

A thermostat 38 may be connected downstream of engine 14 to receive the coolant from engine 14. Thermostat 38 may include a plurality of outlets, including a first outlet connected to jacket water heat exchanger 20, and a second outlet connected to pump 32. Thermostat 38 may be a mechanically-regulated valve configured to partially or fully close one of these outlets based on the temperature of the coolant exiting engine 14. Thermostat 38 may define a plurality of coolant paths: a path in which coolant from thermostat 38 is provided to pump 32 via jacket water heat exchanger 20, and another path in which coolant from thermostat 38 bypasses jacket water heat exchanger 20. Thus, and as shown in FIG. 1, jacket water heat exchanger 20 may be connected between thermostat 38 and pump 32 in loop 56.

Figure 2:
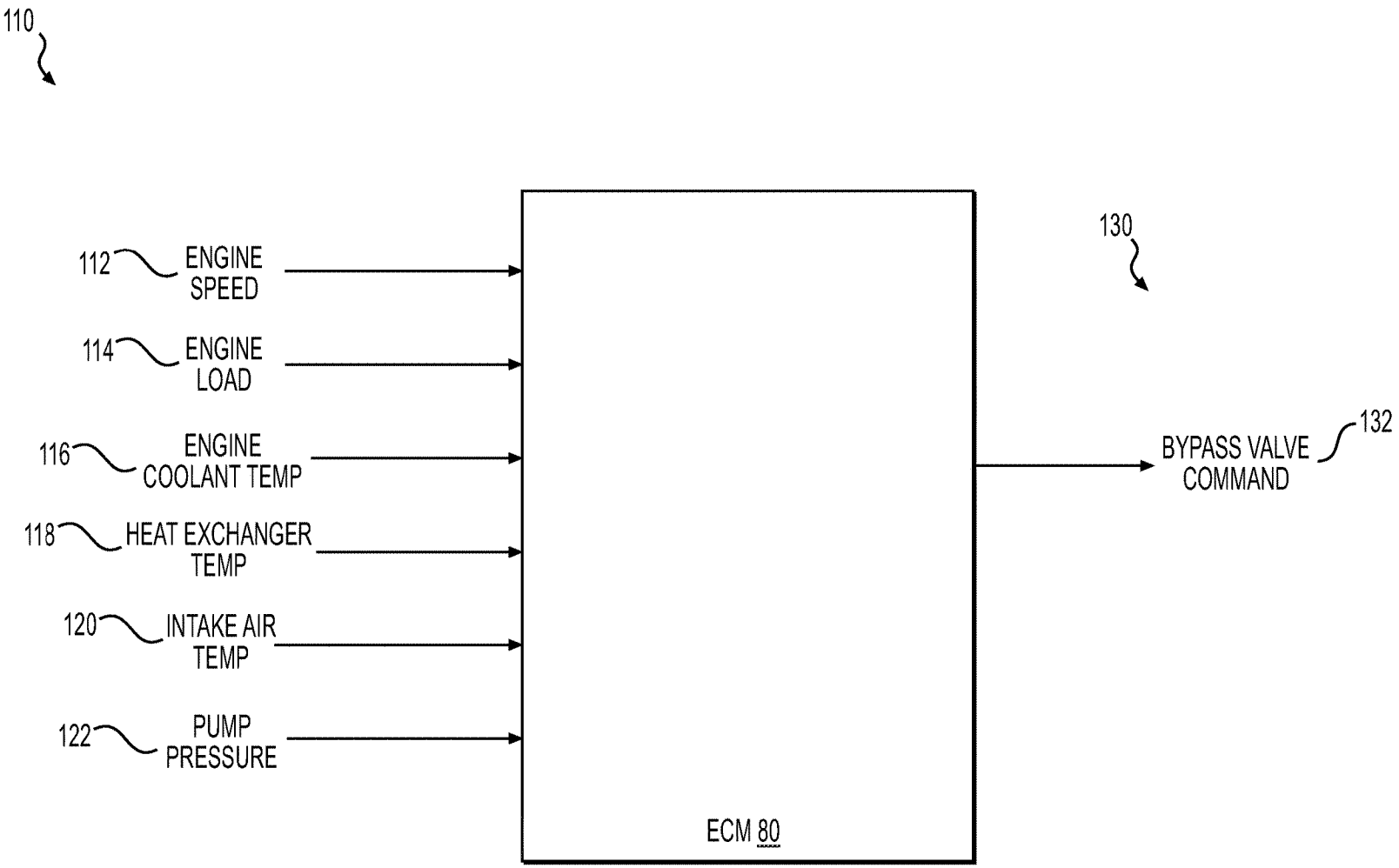
FIG. 2 is a block diagram of an electronic control module that may be used with an electronically-actuated bypass valve, according to aspects of the disclosure.

Sensor system 70 may be configured to monitor aspects of system 12, including one or more signals that may be useful for controlling bypass valve 34. Sensor system 70 may include at least one sensor in communication with ECM 80, such as a heat exchanger temperature sensor 72 to measure a temperature of coolant entering and/or exiting heat exchanger 22, an intake manifold sensor 74 configured to measure intake air temperature, intake air pressure, or both, a pump pressure sensor 75 configured to detect a pressure associated with pump 32, an engine sensor 76 (e.g., an engine speed sensor, engine fuel sensor, etc.), and a jacket water temperature sensor 78 configured to measure coolant temperature. The sensors of sensor system 70 may be configured to generate signals that are received by ECM 80 as inputs 110 (FIGS. 1 and 2). While the sensors of sensor system 70 are shown at exemplary locations in FIG. 1, as understood, one or more of these sensors may be secured at a different position. For example, while jacket water temperature sensor 78 is shown at a position downstream of engine 14, jacket water temperature sensor 78 may include one or more temperature sensors upstream of engine 14, either instead of or in addition to the downstream position illustrated in FIG. 1.

ECM 80 may be enabled, via programming, to generate outputs 130 (e.g., commands) for controlling a position of bypass valve 34 based on one or more conditions of system 12. In particular, ECM 80 may be configured to determine whether engine 14 is in a low load condition or a low temperature condition based on detected values and/or calculated values, including one or more of engine speed, engine load, engine coolant temperature, heat exchanger temperature, intake air temperature, and pump pressure. ECM 80 may be a control unit for controlling internal combustion engine 14 (e.g., by issuing commands to one or more fuel injectors), or may be a separate control unit. If desired, ECM 80 may be in communication with one or more additional electronic control modules, including a supervisory control module, a control module for a transmission system, or a control module that controls fuel injectors of engine 14.

ECM 80 may embody a single microprocessor or multiple microprocessors that receive inputs 110 and generate outputs 130. ECM 80 may include a memory, a secondary storage device, a processor such as a central processing unit, or any other means for accomplishing a task consistent with the present disclosure. The memory or secondary storage device associated with ECM 80 may store data and software to allow ECM 80 to perform its functions, including the functions described with respect to FIG. 2 and one or more steps of method 300 described below. Numerous commercially available microprocessors can be configured to perform the functions of ECM 80. Various other known circuits may be associated with ECM 80, including signal-conditioning circuitry, communication circuitry, and other appropriate circuitry.

FIG. 2 is a block diagram of an exemplary configuration of ECM 80 that may enable functions for preventing overcooling of engine 14 by controlling a position of bypass valve 34. In some aspects, functions performed with ECM 80 may identify when engine 14 is in a low load condition and/or a low temperature condition, and in response, generate a command 132 (also shown in FIG. 1) that causes bypass valve 34 to partially or fully close a fluid path to air cooler heat exchanger 22. When this path is closed, at least some coolant may bypass heat exchanger 22 such that this coolant does not pass through heat exchanger 22 and is not cooled with seawater supplied to heat exchanger 22 via pump 18.

As indicated above, ECM 80 may receive a plurality of inputs 110, including signals from sensor system 70. Inputs 110 may also include one or more calculated values. In particular, inputs 110 for ECM 80 may include an engine speed signal 112, engine load signal 114, engine coolant temperature signal 116, heat exchanger temperature signal 118, intake air temperature signal 120, and pump pressure signal 122.

Engine speed signal 112 may be a signal generated by engine sensor 76 (FIG. 1) that represents a detected speed of engine 14. In particular, engine speed signal 112 may represent a detected speed and/or detected position of a crankshaft or other output shaft connected to engine 14. Engine load signal 114 may be a calculated or detected value the is determined based on current conditions of internal combustion engine 14, such as an amount of air supplied to engine 14 (as measured with intake manifold sensor 74), a quantity or pressure of fuel supplied to engine 14, and/or the speed of engine 14 represented by engine speed signal 112. Engine coolant temperature signal 116 may represent a temperature of coolant in loop 56 and may be generated by jacket water temperature sensor 78. Heat exchanger temperature signal 118 may be generated by heat exchanger temperature sensor 72, and may indicate the temperature of coolant supplied to heat exchanger 22, and in particular, the temperature of coolant at an inlet of heat exchanger 22. Intake air temperature signal 120 may represent the temperature of compressed air supplied to engine 14 (e.g., downstream of a compressor and downstream of charge air cooler charge air cooler 28), as measured with intake manifold sensor 74. Pump pressure signal 122 may represent a pressure of pump 32, and in particular, a pressure difference between an inlet of pump 32 and an outlet of pump 32 (e.g., inlets and outlets of pump 32 for loops 54 and/or 56).

ECM 80 may generate, as an output 130, a command for controlling a state of bypass valve 34. In particular, ECM 80 may generate a bypass valve command 132 that adjusts a position of valve 34 by controlling an amount of electrical energy supplied to actuator 60. Bypass valve command 132 may control the amount of current supplied to a solenoid of actuator 60, a duty cycle of energy supplied to this solenoid, or both, such that valve 34 enters a desired position among the first, second, and third positions described above. When valve 34 is a proportional valve, bypass valve command 132 may be generated to control a quantity of coolant that is supplied to heat exchanger 22 and a quantity of coolant that bypasses heat exchanger 22.

INDUSTRIAL APPLICABILITY

Engine system 12 may be useful in any ship 10 having an internal combustion engine 14 in which overcooling may potentially occur. Engine system 12 may be useful to prevent and/or mitigate overcooling events by providing the ability to prevent flow to a cooling device, such as a heat exchanger. In particular, engine system 12 may block flow and/or divert flow from a cooling device associated with one or more aspects of an internal combustion engine. The overcooling protection may be applied to internal combustion engines 14 useful for generating propulsion with a coupling device 40 and propulsion device 42 of a ship 10, and may also be applied to engines 14 for generating electrical power within ship 10.

Figure 3:
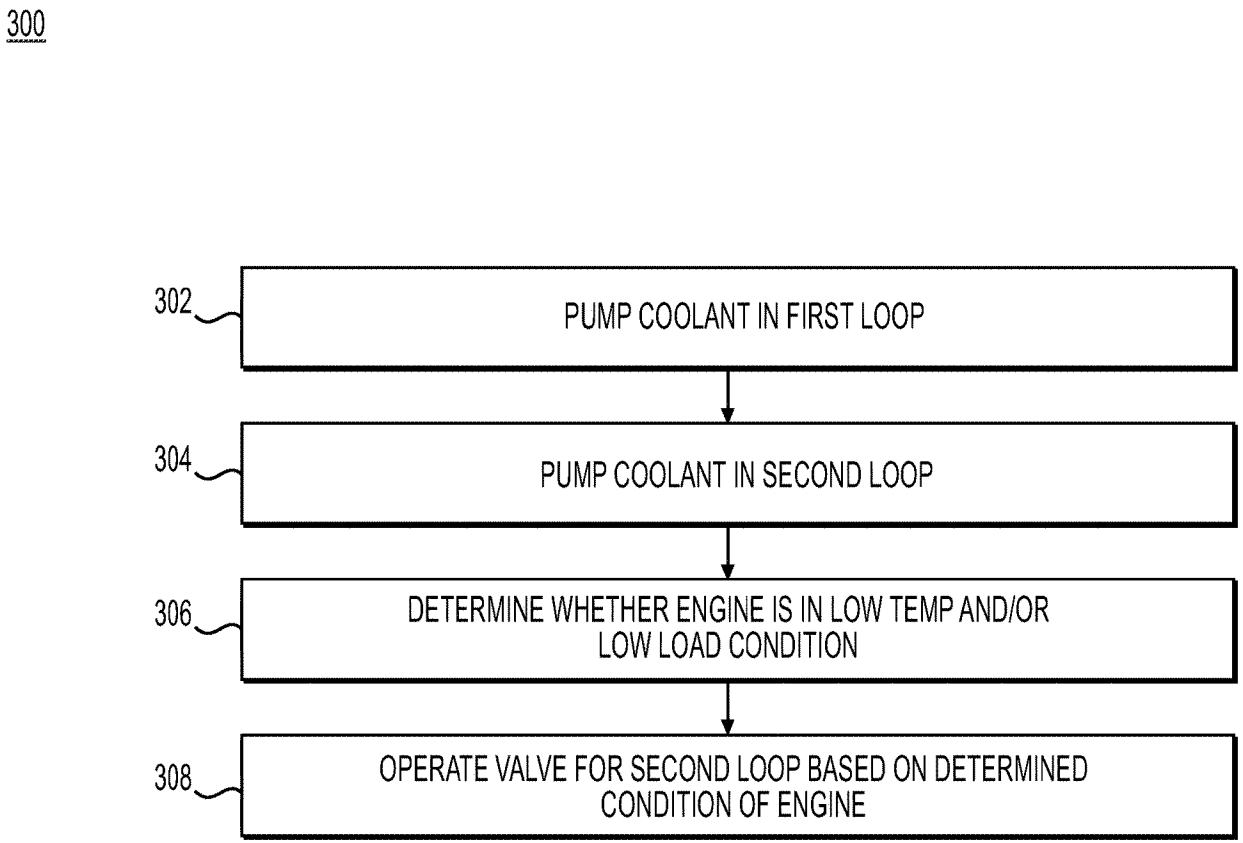
FIG. 3 is a flowchart depicting an exemplary method for controlling a cooling system for an internal combustion engine, according to aspects of the disclosure.

FIG. 3 is a flowchart illustrating an exemplary method 300 for controlling a cooling system, such as cooling system 50, associated with internal combustion engine 14, according to aspects of the present disclosure. Method 300 may be performed while operating engine 14 to generate propulsion or electrical power for ship 10. Method 300 may be performed continuously during the operation of engine 14, or in response to a particular condition (e.g., a startup of engine 14 from a stopped state).

A step 302 of method 300 may include pumping, with pump 32, coolant in a first loop, such as loop 56 (represented with solid lines in FIG. 1, as noted above) for supplying coolant to internal combustion engine 14. The coolant may pass through engine oil cooler 36, or may bypass engine oil cooler 36 via a bypass passage (not shown), and may be received within an interior of engine 14. For example, a block of engine 14 may include a water jacket, such that the coolant flows through this jacket and adjacent to one or more cylinders of engine 14. The coolant may return to pump 32 via thermostat 38, either through a path that includes jacket water heat exchanger 20 or a path that bypasses jacket water heat exchanger 20. The path by which coolant returns to pump 32 may depend on the temperature of the coolant. For example, when coolant has a relatively low temperature, thermostat 38 may cause coolant to return directly to pump 32. However, when coolant exiting engine 14 has a relatively high temperature, some or all of this coolant may be directed, via thermostat 38, to jacket water heat exchanger 20, where the coolant is cooled via heat exchange with seawater circulated in seawater supply 52 (represented with dotted lines in FIG. 1).

A step 304 may include pumping, with pump 32, coolant in a second loop, such as loop 54 (represented with dashed lines in FIG. 1). Pumping coolant in loop 54 may supply coolant to a system that guides air (e.g., compressed air) to engine 14. This coolant may be the same as the coolant that is pumped with pump 32 in step 302. Thus, steps 302 and 304 may include pumping coolant with a single pump, such that the engine system 12 includes no more than two pumps for the cooling system, one seawater pump and one coolant pump. Step 304 may include supplying this coolant to bypass valve 34.

A step 306 may include determining whether engine 14 is in a low temperature condition, a low load condition, or both. Step 306 may include receiving, with ECM 80, one or more of the above-described inputs 110, and determining whether engine 14 is in a low load condition or a cold condition based on inputs 110. In particular, engine 14 may be determined to be in a low load condition based on engine speed signal 112, engine load signal 114, air temperature signal 120, and pump pressure signal 122. In some aspects, ECM 80 may be configured to calculate engine load 114 based on fuel rate and engine speed (e.g., by retrieving engine load and/or engine torque values from a map, based on values of fuel rate and engine speed). Alternatively, ECM 80 may be configured to calculate engine load 114 based on a quantity of air supplied to engine 14. ECM 80 may determine that engine load 114 represents a low load condition when the value of load 114 is below a predetermined load threshold, whether load 114 is calculated based on the engine speed and quantity of fuel supplied to engine 14, or based on the quantity of air supplied to engine 14.

ECM 80 may be configured to determine that engine 14 is in a low load condition based on a dynamic threshold. For example, the predetermined threshold may vary based on a value that is retrieved from a map, allowing the predetermined threshold to change over time according to current engine conditions. This may allow for partial or complete opening of a path to heat exchanger 22 from bypass valve 34, even when engine load is relatively low, to satisfy one or more engine requirements such as intake manifold temperature, coolant tank temperature, bearing oil temperature, etc. In some aspects, the value of the predetermined threshold, and in particular, the threshold value map, may be set based on the rating (e.g., maximum output) of engine 14. In other examples, the predetermined threshold may be a fixed value (e.g., about 30% of the maximum rated load of engine 14).

ECM 80 may determine that engine 14 is in a low temperature condition when coolant temperature signal 116 indicates that the temperature of coolant is below a predetermined threshold, such as about 70 degrees Celsius. However, in some embodiments, ECM 80 may determine that engine 14 is in a low temperature condition based on heat exchanger temperature signal 118, air temperature signal 120, and/or other factors, either in addition to or instead of engine coolant temperature signal 116. ECM 80 may determine that engine 14 is in a low temperature condition when engine coolant temperature signal 116, heat exchanger temperature signal 118, or intake air temperature signal 120 indicates that the temperature of engine 14 and/or the temperature of coolant supplied to engine 14 is below a predetermined threshold. In particular, ECM 80 may determine that engine 14 is in a low temperature condition when one of these signals, two or more of these signals, or all of these signals is consistent with a coolant temperature of less than about 70 degrees Celsius.

Step 308 may include operating valve 34 in response to the determination performed in step 306. Step 308 may include generating a command for controlling valve 34, such as bypass valve command 132, that allows ECM 80 to control a state of actuator 60. In response to a determination that engine 14 is in a low temperature condition or a low load condition, ECM 80 may generate a command 132 to cause valve 34 to divert at least some coolant away from air cooler heat exchanger 22, by at least partially closing an outlet of valve 34 that supplies coolant to heat exchanger 22. Command 132 may be generated to divert at least some coolant in response to determining that engine 14 is in a low temperature condition, in response to determining that engine 14 is in a low load condition, or in response to determining that engine 14 is both in a low temperature condition and a low load condition. Thus, command 132 may be based on either the predetermined temperature threshold, the predetermined load threshold, or both thresholds.

The position of this outlet valve commanded via command 132 may be based on the severity of the low temperature or low load condition. For example, when ECM 80 determines that a condition of engine 14 is below a first threshold associated with the low load condition (e.g., load below a first value retrieved from a map, or a below a first fixed value such as 30%) or the low temperature condition (e.g., coolant temperature below 70 degrees Celsius), valve 34 may divert a relatively small amount of coolant away from heat exchanger 22. When ECM 80 determines that engine 14 is below a second threshold for the low load condition (e.g., load below a second value retrieved from a map or below a second fixed value such as 10%) or a second threshold for the low temperature condition (e.g., coolant temperature below 50 degrees Celsius), ECM 80 may issue a command 132 that causes valve 34 to divert a larger amount of coolant, and in particular, issue command 132 to divert an entirety of this coolant by fully closing an outlet of valve 34.

ECM 80 may stop diverting coolant with valve 34 when engine 14 is no longer in the low temperature condition or low load condition, allowing coolant to again be supplied to air cooler heat exchanger 22. For example, ECM 80 may determine that engine 14 exceeds the first threshold associated with the low temperature condition or the low load condition and in response, allow at least some flow of coolant to heat exchanger 22. In some configurations, ECM 80 may stop diverting coolant when the condition of engine 14 is above a threshold that his higher than the above-described first threshold. This may avoid frequently changing the position of valve 34.

While steps 302, 304, 306, and 308 have been described in an exemplary sequence, as understood, one or more of these steps may be performed simultaneously or performed and/or repeated in a different order. Moreover, any two or more of these steps may be performed simultaneously and/or at overlapping periods of time.

System 12 and method 300 may be useful for various types of internal combustion engines 14 that include an engine which can be subject to overcooling. In such environments, system 12 may be useful for preventing overcooling, especially when flow from a single pump is split between plural circuit or loops (e.g., a loop for cooling an engine and cooling engine oil, and a loop for cooling intake air). The system may adapt to low load or low temperature conditions in which the air compressor does not result in the generation of significant amounts of heat, for example due to a relatively small amount of pressure generated with the compressor. By allowing coolant to bypass an air system heat exchanger, the temperature of the coolant may be maintained at a desired threshold temperature, or higher. Preventing overcooling may optimize engine performance, reduce wear, and increase engine life, without the need to install a third or additional coolant pump, thus retaining the space and cost savings that may be associated with a two-pump coolant system.

It will be apparent to those skilled in the art that various modifications and variations can be made to the disclosed system and method without departing from the scope of the disclosure. Other embodiments of the system and method will be apparent to those skilled in the art from consideration of the specification and system and method disclosed herein. It is intended that the specification and examples be considered as exemplary only, with a true scope of the disclosure being indicated by the following claims and their equivalents.

What is claimed is:

1. A cooling system, comprising:

an internal combustion engine;

a coolant pump in fluid communication with the internal combustion engine;

a liquid-to-liquid heat exchanger configured to receive coolant from the internal combustion engine via the coolant pump, the liquid-to-liquid heat exchanger being connected in a closed loop of the cooling system that includes an air cooler; and a bypass valve connected downstream of the coolant pump, the bypass valve configured to close a fluid path that connects the coolant pump and the liquid-to-liquid heat exchanger.

2. The cooling system of claim 1, wherein the bypass valve is configured to cause the coolant to bypass the liquid-to-liquid heat exchanger when the internal combustion engine is in a low load condition.

3. The cooling system of claim 1, wherein the closed loop of the cooling system is a first coolant loop, the cooling system further including:

a second coolant loop; and a single pump configured to supply coolant to both the first coolant loop and the second coolant loop.

4. The cooling system of claim 1, wherein the liquid-to-liquid heat exchanger is connected to the air cooler such that the air cooler is configured to receive coolant from the liquid-to-liquid heat exchanger.

5. The cooling system of claim 1, wherein the bypass valve is a three-way proportional valve connected to a fluid path that bypasses the liquid-to-liquid heat exchanger.

6. The cooling system of claim 1, wherein the bypass valve is an electronically-controlled valve.

7. The cooling system of claim 6, further comprising an electronic control module configured to generate a signal that causes the electronically-controlled valve to close a fluid path to the liquid-to-liquid heat exchanger in response to determining that the internal combustion engine is in a low load condition or a low temperature condition.

8. A cooling system for a marine engine, the cooling system comprising:

a heat exchanger;

a coolant pump connected between the marine engine and the heat exchanger;

a coolant temperature sensor configured to generate a signal based on a temperature of coolant;

an electronically-controlled bypass valve connected downstream of the coolant pump, the bypass valve including an inlet and a pair of outlets that are both connected upstream of an air cooler, one of the outlets being configured to close a fluid path that connects the coolant pump and the heat exchanger; and an electronic control module configured generate a command for controlling a state of the bypass valve based on the signal from the coolant temperature sensor.

9. The cooling system of claim 8, further comprising:

a first coolant loop including the marine engine; and a second coolant loop including the air cooler, wherein the bypass valve is included in the second coolant loop.

10. The cooling system of claim 9, further including a single pump, the single pump being configured to supply coolant to the first coolant loop and to the second coolant loop.

11. The cooling system of claim 8, wherein the bypass valve is a solenoid-controlled proportional valve.

12. The cooling system of claim 8, wherein the electronic control module is configured to generate a signal to cause the bypass valve to close a fluid path connecting the coolant pump to the heat exchanger.

13. A method for controlling a cooling system for an internal combustion engine, the method comprising:

pumping coolant in a first loop for cooling an interior of the internal combustion engine;

pumping coolant in a second loop for cooling air supplied to the internal combustion engine;

determining, with an electronic control module, whether the internal combustion engine is in a low load state or a low temperature state based on a plurality of different load thresholds or a plurality of different temperature thresholds; and in response to determining that the internal combustion engine is in the low load state or the low temperature state, generating a signal to close a portion of the second loop.

14. The method of claim 13, wherein the portion of the second loop is closed with an electronically-controlled valve when the electronic control module determines that the internal combustion engine is in the low load state according to a current load threshold.

15. The method of claim 14, wherein the electronically-controlled valve causes fluid to bypass a liquid-to-liquid heat exchanger of the second loop.

16. The method of claim 13, further including cooling the coolant in the first loop and the second loop with seawater.

17. The method of claim 13, wherein the coolant is pumped in both the first loop and the second loop with a single pump.

18. The method of claim 13, wherein the internal combustion engine is determined to be in the low load state or the low temperature state based on a detected jacket water temperature and a detected intake air temperature.

19. The method of claim 18, further including partially closing the portion of the second loop based on the detected jacket water temperature and the detected intake air temperature.

20. The method of claim 13, wherein the electronic control module determines that the internal combustion engine is in the low temperature state based on a plurality of temperature signals received with the electronic control module from a respective plurality of temperature sensors.

* * * * *